US006688692B2

(12) United States Patent
Phillips et al.

(10) Patent No.: US 6,688,692 B2
(45) Date of Patent: Feb. 10, 2004

(54) LOCKING DEVICE FOR CHAIR SEAT HORIZONTAL ADJUSTMENT MECHANISM

(75) Inventors: Matthew J. Phillips, Muscatine, IA (US); Jay R. Machael, Muscatine, IA (US); Brian R. Trego, Muscatine, IA (US)

(73) Assignee: Hon Technology Inc., Muscatine, IA (US)

( * ) Notice: Subject to any disclaimer, the term of this patent is extended or adjusted under 35 U.S.C. 154(b) by 0 days.

(21) Appl. No.: 09/881,896

(22) Filed: Jun. 15, 2001

(65) Prior Publication Data

US 2002/0190558 A1 Dec. 19, 2002

(51) Int. Cl.[7] ..... A47C 1/023

(52) U.S. Cl. ..... 297/337; 297/344.1; 248/424; 248/429

(58) Field of Search ..... 297/337, 252, 297/344.1, 383; 248/424, 429, 298.1, 622, 425

(56) References Cited

U.S. PATENT DOCUMENTS

| | | | | | |
|---|---|---|---|---|---|
| 3,235,308 | A | * | 2/1966 | Conner | 297/337 |
| 3,982,785 | A | | 9/1976 | Ambasz | 297/337 X |
| 5,035,466 | A | | 7/1991 | Mathews et al. | 297/337 |
| 5,074,620 | A | | 12/1991 | Jay et al. | 297/337 |
| 5,390,978 | A | | 2/1995 | Janisch | 297/337 X |
| 5,556,163 | A | | 9/1996 | Rogers, III et al. | 297/337 X |
| 5,575,534 | A | | 11/1996 | Yu | 297/337 X |
| 5,607,204 | A | | 3/1997 | Gryp | 297/337 X |
| 5,755,488 | A | | 5/1998 | Beda et al. | 297/337 X |
| 5,755,490 | A | | 5/1998 | Lamart | 297/337 X |
| 5,873,634 | A | | 2/1999 | Heidmann et al. | 297/337 X |
| 6,027,168 | A | | 2/2000 | Crossman et al. | 297/337 |
| 6,027,169 | A | * | 2/2000 | Roslund, Jr. | 297/337 |
| 6,099,076 | A | | 8/2000 | Nagel et al. | 297/337 |
| 6,135,556 | A | | 10/2000 | Chu | 297/337 |
| 6,193,313 | B1 | * | 2/2001 | Jonsson | 297/337 X |
| 6,203,107 | B1 | * | 3/2001 | Jonsson | 297/337 |
| 6,402,245 | B1 | * | 6/2002 | Newton et al. | 297/337 X |
| 2001/0050503 | A1 | * | 12/2001 | Piretti | 297/337 |
| 2002/0074841 | A1 | * | 6/2002 | Chen | 297/337 |

* cited by examiner

*Primary Examiner*—Rodney B. White
(74) *Attorney, Agent, or Firm*—Jones Day

(57) ABSTRACT

A locking device for allowing horizontal seat positioning of a chair seat has a friction strip or brake pad between a seat pan and a seat plate. A screw and spring assembly is used to resiliently hold the seat pan and the seat plate together such that by lifting up on the forward portion of the seat pan, the friction strip, if attached to the seat plate, is separated from the seat pan allowing the seat pan to be moved horizontally in forwardly and rearwardly directions, thus adjusting the seat position. When the front of the seat pan is lifted substantially vertically, the screw and spring assembly is compressed to allow the seat pan to separate sufficiently from the friction strip and allow relative movement of the seat pan with respect to the seat plate. As an alternative, a lever may be used to loosen a locking mechanism and therby allow seat adjustment.

22 Claims, 5 Drawing Sheets

LOCKING DEVICE FOR CHAIR SEAT HORIZONTAL ADJUSTMENT MECHANISM

BACKGROUND OF THE INVENTION

1. Field of the Invention

This invention relates generally to chair seat adjustment mechanisms and in particular to a mechanism that allows the horizontal fore and aft position of the chair seat to be adjusted relative to the base of the chair.

2. Description of Related Art Including Information Disclosed Under 37 C.F.R. §§1.97 and 1.98

There are many devices for adjusting a chair seat in the horizontal direction. Such devices are found in U.S. Pat. Nos. 6,027,168; 6,099,076; 5,755,490; and 5,035,466.

Each of these devices requires a mechanical movement of a locking lever of some type to hold the seat in place in a selected horizontal position. Many of these mechanical devices are very complicated and thus expensive to manufacture and are sometimes very bulky and difficult to use.

It would be advantageous to have a chair seat horizontal adjustment mechanism that in one embodiment does not require any mechanical operation of a lever or such device by the user and in another embodiment has a very simple lever mechanism to enable movement of the chair seat.

SUMMARY OF THE INVENTION

The present invention has a rigid seat plate that forms a base for a chair seat. A seat pan, having a front portion and a rear portion, is mounted on top of the seat plate. A stop strip or brake pad having a high coefficient of friction is placed between and attached to one of the seat plate and the seat pan. At least one slot extends longitudinally in the seat plate at least partially between the front and rear seat pan portions. A screw and spring assembly in the form of a resilient means extends through the at least one slot for holding the seat pan to the seat plate with the brake pad therebetween to prevent relative movement between the seat pan and the seat plate. The resilient means or spring enables the forward portion of the seat pan to be lifted so as to separate the brake pad from the other one of the seat plate and seat pan to allow the seat pan to move forwardly and rearwardly along the at least one slot with respect to the seat base to adjust the seat horizontal position. In the preferred embodiment, at least two parallel-spaced, longitudinally-extending slots are formed in the seat plate and first and second screw and spring assemblies extend through each of the parallel-spaced slots and the seat plate, respectively, for threadedly engaging the seat pan while enabling the front portion of the seat pan to be urged against the spring assembly and to separate the brake pad from the other one of the seat pan and seat plate to allow the seat pan to move forwardly and rearwardly about the resilient means to adjust the seat position. In addition, third and fourth screw assemblies may be mounted in the at least first and second parallel-spaced slots in the rear portion of the seat pan for resiliently holding the rear portion of the seat pan to the seat plate so as to enable the front part of the seat pan to be moved vertically to separate one of the seat pan and the seat plate from the brake pad.

The third and fourth screw assemblies comprise a screw having a head portion and a threaded portion for extending through the at least first and second spaced parallel slots in the seat plate to threadedly engage the seat pan. A washer, having a low coefficient of friction, is placed on the screw and engages the seat plate. A resilient spacer surrounds the screw between the washer and the screw head portion such that when the forward portion of the seat pan is lifted substantially vertically, the resilient spacer is at least partially compressed on at least one side thereof thereby allowing the seat pan to pivot in the vertical direction substantially about the third and fourth screw assemblies to separate the brake pad from the other one of the seat plate and the seat pan.

The brake pad is in the form of an elongated rectangular friction strip that extends laterally across one of the seat pan and the seat plate and is rigidly attached thereto. The elongated brake pad friction strip is attached to one of the seat pan and seat plate forwardly of the first and second screw and spring assemblies. In the preferred embodiment, the elongated friction brake pad strip is ⅜ inch wide and 8 inches long, although both of the length and the width could vary. Further, in the preferred embodiment, the elongated friction pad strip is rigidly attached to the seat plate, although it can be rigidly attached to the seat pan. Further, in the preferred embodiment, the seat plate is formed of aluminum, but it could also be formed of high-impact plastic.

In a second embodiment, a simple arrangement is provided wherein the friction lock between a seat plate support and a seat pan support can be mechanically released such as by a lever, push-rod, cable, or the like.

Thus, it is an object of the present invention to provide a locking device for horizontal seat positioning on a chair that utilizes a friction pad between the seat plate and the seat pan and an attaching means that will allow the front portion of the seat pan to be lifted, thus separating the seat pan from the friction pad and allowing the seat pan to be adjusted relative to the seat plate. It is another object of the present invention to provide a friction held seat plate support and a seat pan support that can be released by a slight arcuate movement of a mechanical device to enable horizontal sliding of the chair seat for adjustment purposes.

It is also an object of the present invention to place the friction pad forward of the first and second screw and spring assemblies.

It is also an object of the present invention to attach the elongated friction pad strip rigidly to the seat plate.

Thus, the present invention relates to a locking device for horizontal seat positioning on a chair having a forward and a rear portion comprising a rigid seat plate forming a base for a chair seat, a seat pan having a front portion and a rear portion, mounted on top of the seat plate; a brake pad having a high coefficient of friction placed between, and attached to one of, the seat plate and the seat pan; at least one slot extending longitudinally in the seat plate at least partially between the front and rear seat pan portions; and resilient means extending through the at least one slot for holding the seat pan to the seat plate with the brake pad therebetween to prevent relative movement between the seat pan and the seat plate, but also enabling the forward portion of the seat pan to be lifted so as to separate the brake pad from the other of the seat plate and seat pan to allow the seat pan to move forwardly and rearwardly in the at least one slot with respect to the seat base to adjust the horizontal seat position.

The present invention also relates to a locking device for horizontal seat positioning on a chair having a seat plate support and a seat pan support that are held together in a friction arrangement by a screw non-rotatably attached to the bottom of the seat pan support, the screw having external threads facing downwardly toward the seat plate support, a selectively rotatable brake attached to said seat pan support and having internal threads for threadable attachment to the external threads of the non-rotating screw, an activating mechanism is attached to the brake such that with minimal rotation of said brake, the frictional coupling between the seat pan support and the seat plate support is released thereby allowing movement of the seat pan support with respect to the seat plate support.

BRIEF DESCRIPTION OF THE DRAWINGS

These and other objects of the present invention will be more fully disclosed when taken in conjunction with the following detailed description of the drawings wherein like numerals represent like elements and wherein.

DETAILED DESCRIPTION OF THE PREFERRED EMBODIMENT(S)

Figure 1:
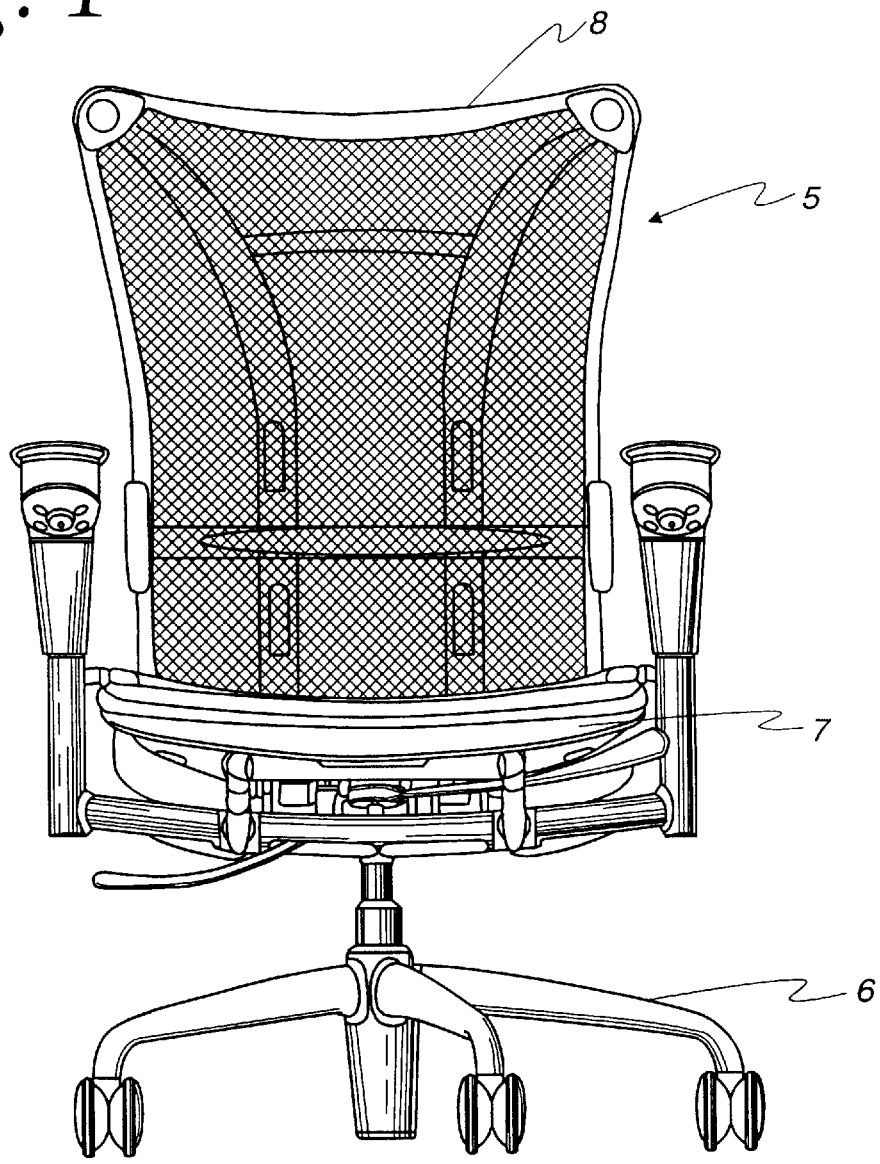
FIG. 1 is a front elevation view of a chair.

Referring to FIG. 1, there is illustrated a chair 5 having a base 6, a seat assembly 7 and a back assembly 8.

Figure 2:
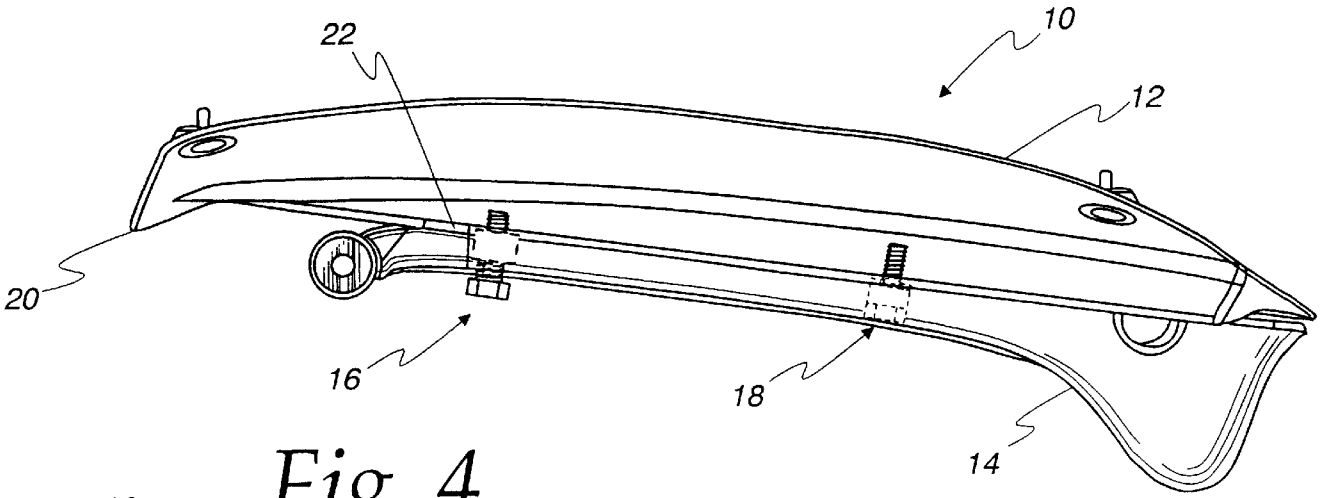
FIG. 2 is a side elevation view of the seat pan and the seat plate attached underneath with the screw and spring assemblies.

As can be seen in FIG. 2, the novel locking device 10 is found as part of the seat assembly and comprises a seat pan 12 and a seat plate 14 to which the seat pan 12 is mounted by means of a resilient device or assembly 16 formed of a screw and spring, as well as a fastening device or assembly 18 which allows or forms a pivot point such that the forward end 20 of the seat pan 12 can be lifted up compressing the spring of the screw and spring assembly 16 allowing a high friction structure such as a brake pad or strip 22 to be separated from the seat pan or the seat plate depending upon where it is mounted. Clearly, it could be mounted either on the bottom side of the seat pan or on the top of the seat plate. The important aspect of the invention is to be able to separate one of the seat pan and the seat plate from the friction strip when the forward portion of the seat pan is lifted upwardly in the vertical direction, thus allowing movement of the seat pan with respect to the seat plate. In the preferred embodiment, the seat plate is made of aluminum and the seat pan is made of high impact plastic. However, those skilled in the art will recognize that both the seat plate and the seat pan may be made of other materials well known in the art.

Figure 3:
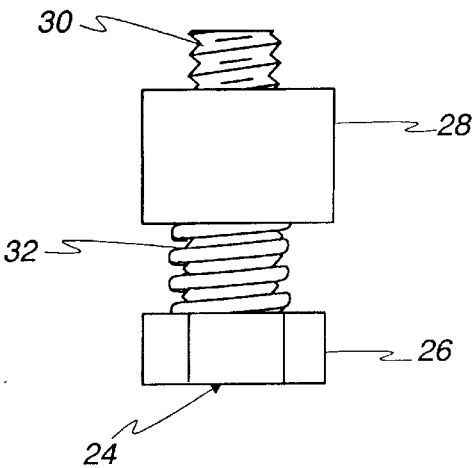
FIG. 3 is a side elevation view of a screw and spring assembly that is used in the forward portion of the seat plate.

FIG. 3 is an enlarged side view of the screw and spring assembly 16. It has a screw or bolt 24 having a head 26, a nylon bushing 28 and threads 30 on the outer end of the screw and spring assembly 16. A spring 32 separates the screw head 26 from the nylon bushing 28. When the outer end 30 of the screw and spring assembly 16 is threaded into a mating orifice in the seat pan, the seat pan is drawn against the seat plate by the bolt head 24 and the seat pan and the seat plate are held together with the friction strip 22 between said seat pan and the seat plate to prevent relative movement of the seat pan and the seat plate.

Figure 4:
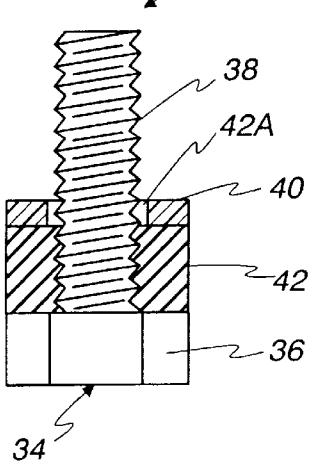
FIG 4 is a partial cross-sectional elevation view of a screw assembly that is used at the rear portion of the seat plate in order to allow or form a pivot point about which the seat pan may be lifted in the vertical direction at the forward end thereof.

FIG. 4 is a partial cross-sectional view of the fastening device 18 that is used as the pivot point when lifting the forward end 20 of the seat pan. As can be seen in FIG. 4, the fastening assembly 18 is a bolt or screw 34 having a head portion 36 and threads on a shaft 38. The bolt or screw 18 extends through the at least first and second spaced parallel slots in the seat plate 14 to engage the seat pan 12. Shaft 38 has a washer 40 thereon, preferably of a very low, or substantially no, coefficient of friction of any well-known type for engaging the seat plate. A resilient spacer 42 is placed between the bolt or screw head 36 and the washer 40 and surrounds the screw shaft 38. The resilient spacer 42 may be made of rubber or any other resilient material. Since there is a small space 42A between the washer 40 and the screw shaft 38, the rubber or resilient material 42 can compress and allow a small pivot point at the rear end portion of the seat. Thus, when the seat pan is lifted, the resilient spacer 42 is at least partially compressed, thereby allowing the seat pan to pivot in the vertical direction about the screw assemblies 18, FIG. 6, to separate the brake pad from the other one of the seat plate and the seat pan. Obviously, a large space is not required since the movement is very small inasmuch as the friction strip 22 is very thin, preferably no thicker than ⅛ inch. Clearly, one skilled in the art could change the friction strip thickness to adapt to different seat sizes and constructions. As stated earlier, the friction strip or brake pad 22 is in the form of an elongated rectangular friction strip that extends laterally across one of the seat pan or the seat plate upon which it is mounted, and is rigidly attached to the desired one of the seat pan or the seat plate in any well-known manner such as by rivets, glue, or the like.

Figure 5:
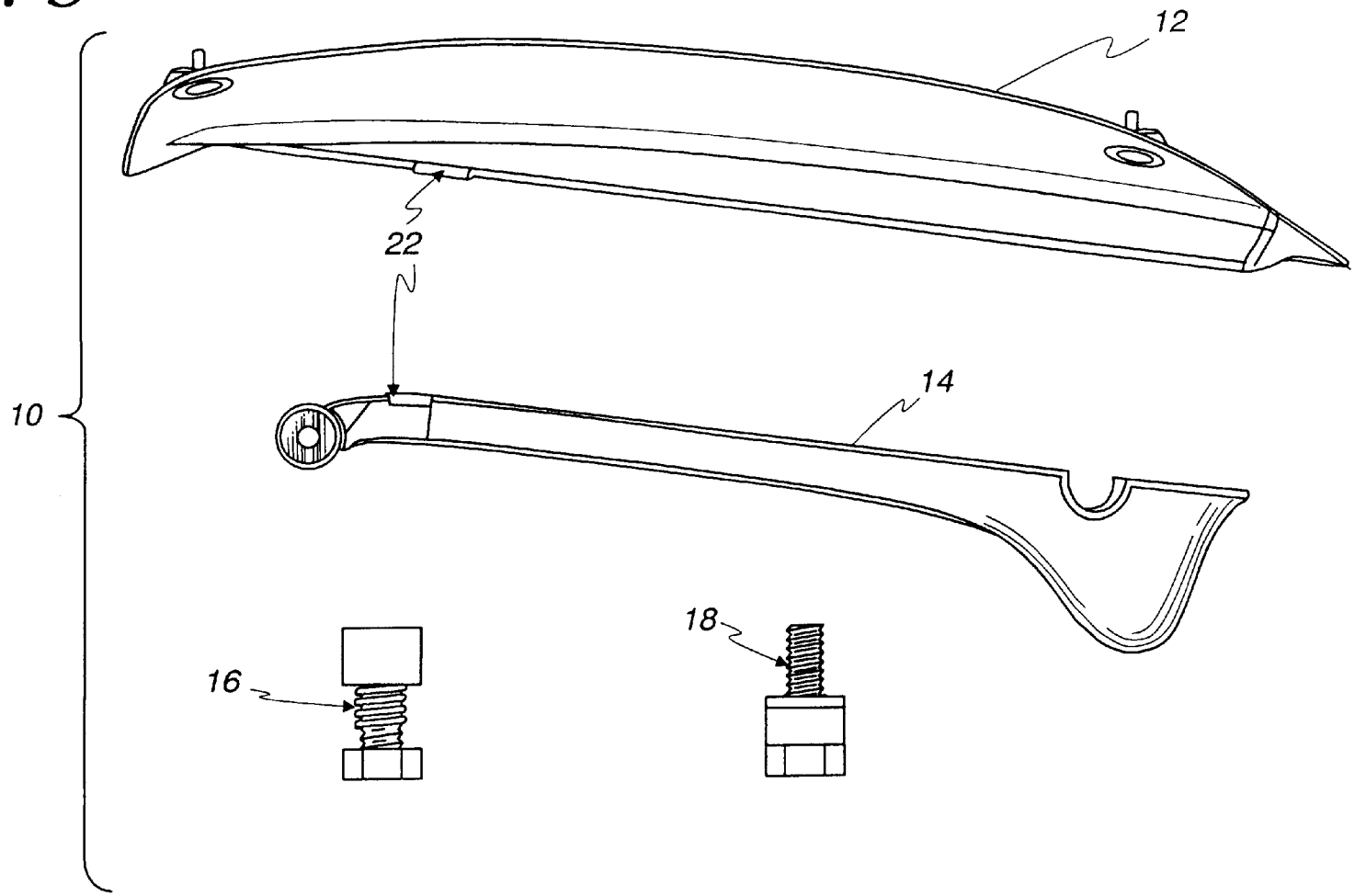
FIG. 5 is an exploded elevation view of the seat pan, the seat plate, and the resilient fastening means and illustrating the position of the stop pad or friction brake.

FIG. 5 is an exploded view of the novel assembly illustrating the seat pan 12, the seat plate 14 and the friction strip 22 which can be attached to either of the seat pan 12 or the seat plate 14. In the preferred embodiment, the friction strip 22 is attached to the seat plate, but one skilled in the art will recognize that it could also be placed on the seat pan 12 and it is shown in both locations for purposes of illustration. Further, FIG. 5 illustrates the screw and spring assembly 16 and the fastening device 18 that forms the pivot point enabling the front of the seat pan 12 to be lifted with respect to the seat plate 14.

Figure 6:
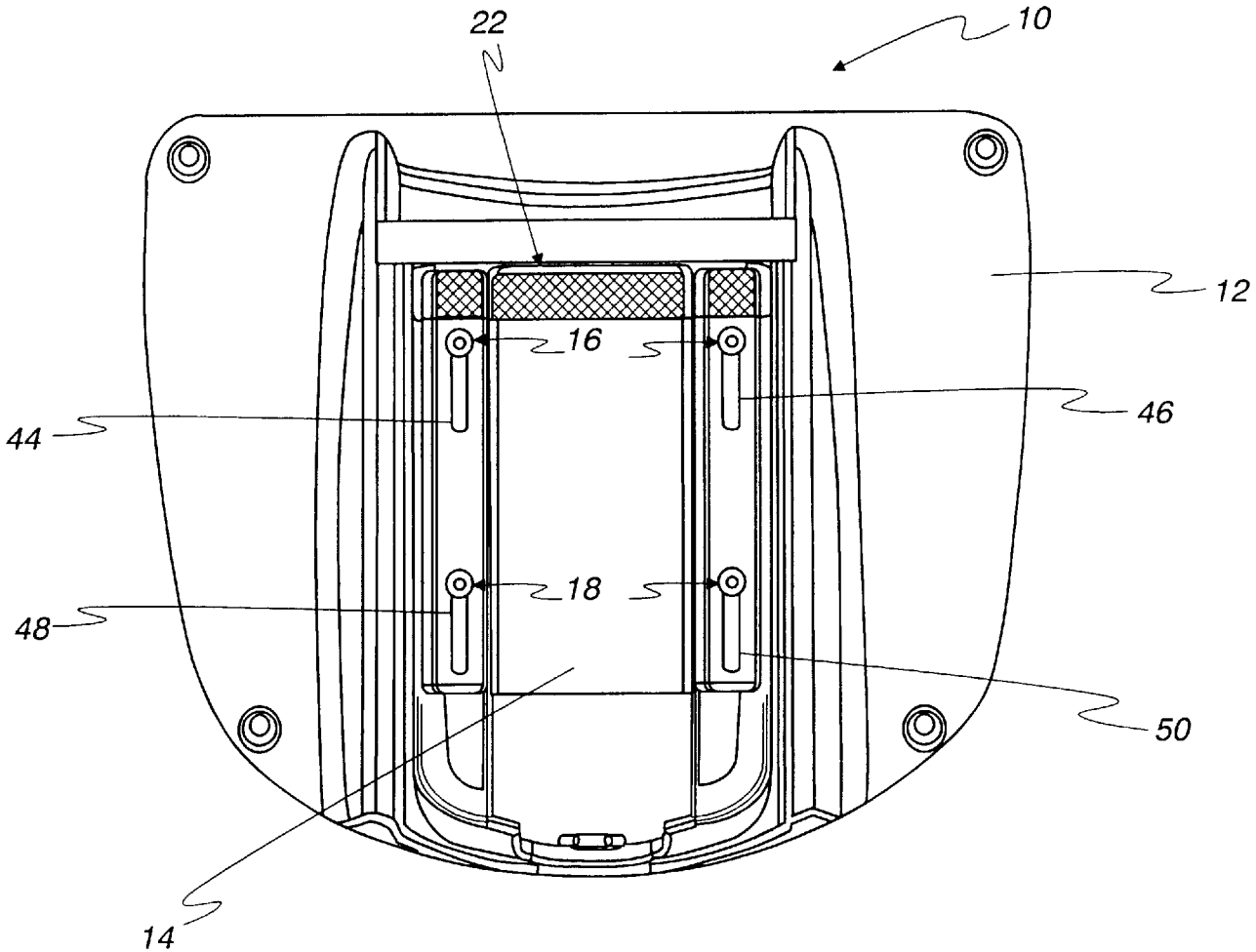
FIG. 6 is a bottom plan view of the seat plate with the seat pan thereon and illustrating the slots in which the resilient means are located and illustrating where the stop strip or brake pad is placed.

FIG. 6 is a bottom plan view of the seat-locking device 10 illustrating the seat pan 12, the seat plate 14 attached thereto by screw and spring assemblies 16 and fastening screw assemblies 18 at the rear thereof and parallel slots 44, 46, and 48, 50. Clearly, one elongated slot could be used on each side or, if absolutely necessary, a single slot in the middle of the seat plate could be used. The preferred embodiment is to have the two sets of spaced parallel slots 44, 46, and 48, 50 as shown in FIG. 6.

It can be seen in FIG. 6 that the brake pad or strip 22, shown as a hatched area, is placed forwardly of the screw and spring assembly 16. Such positioning provides not only the necessary friction to stop movement between the seat pan 12 and the seat plate 14, but also allows a small vertical movement of the seat pan 12 to separate the seat pan 12 from the effects of the brake pad or strip 22 so that relative movement can occur between the seat pan 12 and the seat plate 14. As stated previously, in the preferred embodiment the brake pad or strip 22 is ⅛ inch thick, ⅜ inch wide and 8 inches long. One skilled in the art will recognize that these sizes can be varied to be tailored for a particular chair size or construction.

Figure 7:
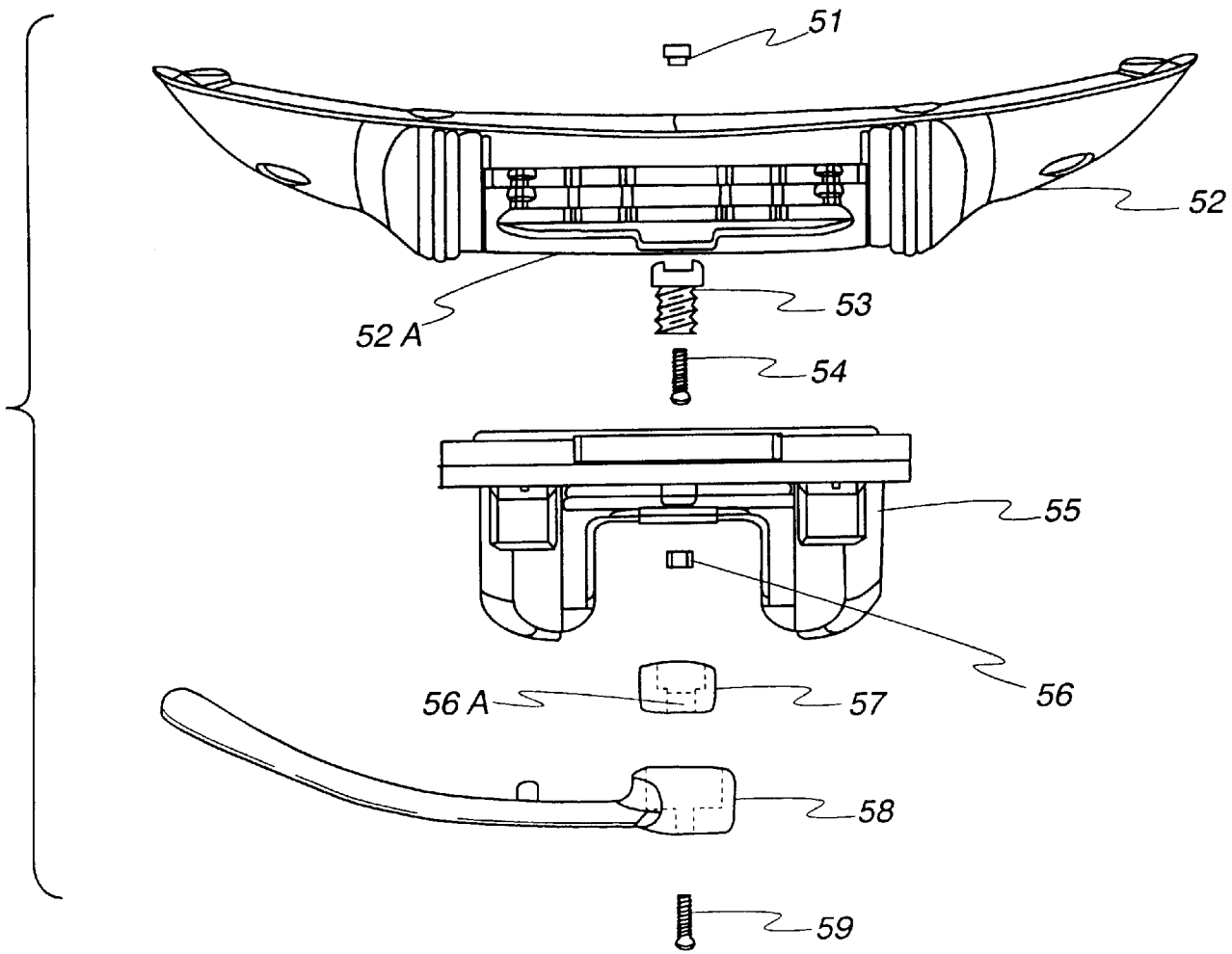
FIG. 7 is an exploded front elevation view of the novel locking mechanism that includes an activated mechanism that can temporarily and easily remove frictional locking engagement between the seat plate support and the seat pan support.

FIG. 7 is an exploded view of the preferred alternate embodiment of the present invention that includes an activated mechanism that can temporarily and easily remove frictional locking engagement between a seat plate support and a seat pan support. As can be seen in FIG. 7, a design is presented that creates a locking mechanism that stops the movement of two plates in planar motion. The design is such that it uses a screw 53 fixed to the bottom 52A of the seat pan support 52 using a bolt 54 and a nut 51. The screw 53 and seat pan support 52 are keyed to one another in a well known manner such that they cannot rotate with respect to each other. A brake 57, having internal threads, is threaded onto the screw 53, to trap a seat plate support 55. The pressure/friction of the brake 57 pushing on the seat plate support 55 causes the seat plate support 55 and the seat pan support 52 to lock to each other.

A lever 58 is friction fit and fastened to the brake 57 using a bolt 59 and a nut 56. The nut 56 is inset in a recess 56A, shown in phantom lines, molded into the brake 57 such that the nut 56 will not rotate with respect to the brake 57. The screw 53 is threaded such that when the brake 57 is rotated minimally with lever 58 in one direction about the screw 53, the action separates the brake 57 from the seat plate support 55 by rotatably moving the brake 57 on the screw 53. The separation then allows the seat pan support 52 to move relative to the seat plate support 55. The brake 57 is returned to its locked position where the seat pan and the seat plate are not separated by moving the lever 58 in an opposite direction to that direction originally moved.

The activation of the brake 57 could be accomplished in many ways as known to those skilled in the art. Such activation could be accomplished, for example, by a cable system assembly that would minimally rotate the brake 57, a push rod assembly so coupled to the brake 57 that pushing and pulling on the rod would give the brake 57 the necessary minimal rotation. The lever 58 is, however, the preferred embodiment. The fit and fastening of the brake 57 and the lever 58 allows assembly workers to fasten the brake 57 to the required torque to stop relative movement of the seat plate and the seat pan, then install the lever 58 in its preferred position with respect to the chair so as to allow for variances in the thickness of materials used in a production atmosphere while still keeping the lever 58 in the same place from an end user=3 s point of view.

Thus, there has been disclosed a locking mechanism having screw and spring assemblies that are used to fasten the seat pan to the seat plate from the bottom side of the seat plate. The screw is threadedly fastened to the seat pan through an elongated slot in the seat plate. A washer having a very low coefficient of friction is held in position against the seat plate by the screw and the force of the spring pushing the washer against the seat plate. The spring force is such as to draw the seat pan and the seat plate together. The friction strip or brake pad is fastened to the seat plate so that it can then use friction to lock the seat plate to the seat pan and prevent horizontal motion of the seat pan with respect to the seat plate. The friction strip or brake pad is made of a material that has the property of a high coefficient of friction and is durable such as rubber, rubber compositions, or other well known friction-causing elements. The seat pan is unlocked from the rear of the plate by lifting the front of the seat pan up in a substantially vertical plane thus creating a separation of the brake pad on the seat plate from the seat pan and allowing relative horizontal motion of the seat pan to take place with respect to the seat plate. The separation of the seat pan from the seat plate (and from the brake pad) is enabled by the creation of a unique pivot point substantially around an axis created by a bolt having a compressible washer. Upon letting go of the seat pan, the force of the springs on the screw-spring support assembly forces the plate and the pan together, with the brake pad therebetween, thus locking the seat in the position desired by the user. The slots in the seat plate control the orientation of the movement of the seat pan.

There has also been disclosed an alternate embodiment of the novel invention using a simple lever mechanism that, with minimal rotation, releases the locking engagement of the chair seat plate support and the seat pan support to allow the seat pan support to be moved in the forward and the rearward directions relative to the seat plate support. A screw having exposed threads is non-rotatably attached to the seat pan support. A brake, having internal threads, is rotatably attached to the seat plate support and threadedly attached to the exposed threads of the screw. An operating mechanism, such as a lever, is attached to the brake for rotating it a minimal amount in one direction to release the seat plate support and the seat pan support from locking engagement so that the chair seat on the seat pan support can be moved forwardly and backwardly by the user. After the seat position has been adjusted in the forward or rearward directions, the lever can be moved in a minimal amount in the opposite direction to once again lock the seat plate support to the seat pan support.

Although the invention has been described with reference to the preferred embodiment illustrated in the attached drawing figures, it is noted that substitutions may be made and equivalents employed here and without departing from the scope of the invention as recited in the claims.

We claim:

1. A chair having a locking device for horizontal seat positioning comprising:

a rigid seat plate;

a seat pan, having a front portion and a rear portion, mounted on top of said seat plate;

a structure having a high coefficient of friction placed between, and attached to one of, said seat plate and said seat pan;

at least one slot in said seat plate at least partially between said front and rear seat pan portions, said slot extending in the direction of horizontal seat positioning; and resilient means extending through said at least one slot for holding said seat pan to said seat plate with said high friction structure therebetween to prevent relative movement between said seat pan and said seat plate, said resilient means enabling the front portion of said seat pan to be lifted so as to separate said high friction structure from the other of said seat plate and said seat pan to allow said seat pan to move forwardly and rearwardly along said at least one slot with respect to said seat plate to adjust horizontal seat positioning.

2. The chair of claim 1 wherein said resilient means comprises:

at least two parallel-spaced slots in said seat plate; and first and second screw and spring assemblies, one extending through each of said parallel-spaced slots in said seat plate, for threadedly engaging said seat pan while enabling the front portion of said seat pan to be urged against said spring assemblies and to separate said high friction structure from the other of said seat pan and said seat plate to allow said seat pan to move forwardly and rearwardly about said resilient means to adjust the seat position.

3. The chair of claim 2 wherein said resilient means further includes:

said first and second screw and spring assemblies mounted in said parallel slots and being threadedly connected to the front portion of said seat pan; and third and fourth screw assemblies mounted in said at least two parallel-spaced slots and threadedly connected to the rear portion of said seat pan for resiliently holding the rear portion of said seat pan to said seat plate so as to enable the front portion of said seat pan to be moved vertically to separate one of said seat pan and said seat plate from said high friction structure.

4. The chair of claim 3 wherein each of said third and fourth screw assemblies comprises:

a screw for extending through said at least two spaced parallel slots in said seat plate, said screw having a head portion and a threaded portion, said threaded portion to threadedly engage said seat pan;

a washer on said screw having a low coefficient of friction for engaging said seat plate; and a resilient spacer surrounding said screw between said washer and said screw head portion such that when the front portion of said seat pan is lifted, said resilient spacer is compressed thereby allowing said seat pan to pivot in the vertical direction about said third and fourth screw assemblies to separate said high friction structure from the other one of said seat plate and said seat pan.

5. The chair of claim 4 wherein said resilient spacer is made of rubber.

6. The chair of claim 1 further comprising:

said high friction structure is in the form of an elongated rectangular strip extending laterally across one of said seat pan and said seat plate; and attaching means for rigidly attaching said elongated strip to said one of said seat pan and said seat plate.

7. The chair of claim 6 wherein said elongated strip is rigidly attached to one of said seat pan and said seat plate forwardly of said resilient means.

8. The chair of claim 7 wherein said elongated strip is ⅛ inch thick, ⅜ inch wide and 8 inches long.

9. The chair of claim 8 wherein said seat plate is formed of aluminum.

10. The chair of claim 9 wherein said seat plate is formed of high impact plastic.

11. The chair of claim 6 wherein said elongated strip is rigidly attached to said seat pan.

12. The chair of claim 6 wherein said elongated strip is rigidly attached to said seat plate.

13. A chair having a device for enabling horizontal seat positioning, said chair having a seat plate support and a seat pan support, said seat pan support being mounted above the seat plate support such that said seat pan support and said seat plate support can be selectively locked together or unlocked to allow horizontal seat positioning adjustment, said device comprising:

a screw non-rotatably attached to the seat pan support, said screw having threads thereon facing said seat plate support; and a brake assembly attached to said seat plate support, internal threads on said brake assembly for threadedly engaging said screw threads for partial rotation thereon between a first position wherein said seat plate support and said seat pan support are locked to prevent relative movement thereof and a second position wherein said seat plate support from said seat pan support are unlocked to allow relative movement thereof.

14. The chair as claimed in claim 13 further including a mechanical device coupled to said brake assembly for locking and unlocking said seat plate support and said seat pan support by arcuate rotation of said brake assembly in first and second directions.

15. A chair having a device for selectively enabling movement of a chair seat and the forward and rearward horizontal direction with respect to a chair base comprising:

a chair seat;

a chair base;

first and second engaging members associated respectively with said chair seat and said chair base, said first engaging member rotatably movable with respect to said second engaging member from a first position to a second position for locking said chair seat in a fixed position and movable from said second position to said first position to unlock said chair seat for horizontal movement in forward and rearward directions;

a user operated device coupled to said first engaging member for moving said first engaging member from said first position to said second position, said user operated device being a lever connected to said first engaging device, said first engaging device is rotatably attached to said seat base;

an orifice in said first engaging device, said orifice having internal threads;

an elongated second engaging device fixedly attached to said chair seat; and external threads on said elongated second engaging device for threadedly engaging said orifice internal threads for rotation therein from the first position to the second position.

16. A chair having a locking device for horizontal seat positioning on said chair comprising:

a seat plate support and a seat pan support held together by frictional engagement;

a screw non-rotatably attached to the seat pan support;

external threads on said screw facing said seat plate support;

a selectively rotatable brake assembly attached to said seat plate support, said brake assembly having an orifice therein; and internal threads in said brake assembly orifice for threaded attachment to external threads of said non-rotating screw such that arcuate rotation of said brake assembly in a first direction locks said seat plate support to said seat pan support and arcuate rotation of said brake assembly in a second direction unlocks said seat plate support from said seat pan support to allow horizontal seat positioning of said seat pan support.

17. The chair of claim 16 further including a lever attached to said rotatable brake assembly for rotating said brake assembly in said first and second directions.

18. A chair with a locking device for horizontal seat positioning, said chair having a forward position and a rearward position and comprising:

a rigid seat plate forming a base for a chair seat;

a seat pan frictionally mounted on top of said seat plate;

coupling means for releasably holding said seat pan to said seat plate in frictional engagement to prevent relative movement between said seat pan and said seat plate, said couple means enabling said seat pan to be selectively separated from frictional engagement with said seat plate to adjust the seat pan to move forwardly and rearwardly with respect to said seat plate to adjust the seat pan horizontal position;

a front portion and a rear portion on said seat pan:

at least one slot extending longitudinally in said seat plate at least partially between said front and rear seat pan portions; and linking means extending through said at least one slot for selectively holding said seat pan to said seat plate in frictional engagement to prevent relative movement between said seat pan and said seat plate, said linking means enabling said seat pan to be selectively separated from frictional engagement with said seat pan to allow said seat pan to be moved forwardly and rearwardly along said at least one slot with respect to said seat plate to adjust the seat pan horizontal position.

19. The chair of claim 18 wherein said linking means comprises resilient means that can be compressed upon lifting of the front portion of said seat pan to enable the seat pan to be separated from frictional engagement with, and to be moved relative to, said seat plate for chair seat horizontal adjustment.

20. The chair of claim 19 wherein said resilient means comprises at least one screw and spring assembly extending through said at least one slot in said seat plate for threadedly engaging said seat pan to enable the front portion of said seat pan to be urged against said spring assembly and to separate said seat plate and said seat pan from frictional engagement to enable horizontal movement of said seat pan with respect to said seat plate for horizontal seat adjustment.

21. The chair of claim 18 wherein said linking device comprises:

a screw non-rotatably attached to the seat pan, external threads on said screw facing said seat plate; and a selectively rotatable brake assembly attached to said seat plate and having an orifice therein, internal threads in said rotatable brake assembly orifice for threaded attachment to the external threads of said non-rotating screw such that arcuate rotation of said brake assembly in a first direction locks said seat support plate to said seat pan in frictional engagement and arcuate rotation of said brake assembly in a second direction unlocks said frictional engagement of said seat support wherein horizontal seat positioning of said seat pan is allowed.

22. The chair of claim 21 further including a lever attached to said rotatable brake assembly for rotating said brake assembly in said first and second directions.

* * * * *